US007063558B1

(12) United States Patent
Chen

(10) Patent No.: US 7,063,558 B1
(45) Date of Patent: Jun. 20, 2006

(54) ELECTRIC PLUG

(76) Inventor: Tsang-I Chen, Room 707, No. 293, Sung Chiang Rd., Taipei (TW)

( * ) Notice: Subject to any disclaimer, the term of this patent is extended or adjusted under 35 U.S.C. 154(b) by 0 days.

(21) Appl. No.: 11/183,804

(22) Filed: Jul. 19, 2005

(51) Int. Cl.
*H01R 13/00* (2006.01)

(52) U.S. Cl. ..... 439/484; 439/483

(58) Field of Classification Search ..... 439/484, 439/483, 160, 694
See application file for complete search history.

(56) References Cited

U.S. PATENT DOCUMENTS 4,969,838 A * 11/1990 Himes et al. ..... 439/352
5,057,036 A * 10/1991 Dickie ..... 439/484
5,567,181 A * 10/1996 Lentz et al. ..... 439/694
5,679,014 A * 10/1997 Lan-Jen ..... 439/160
5,971,801 A * 10/1999 Kato et al. ..... 439/511
6,089,924 A * 7/2000 Wang ..... 439/694
6,736,666 B1 * 5/2004 Yu ..... 439/484

* cited by examiner

*Primary Examiner*—Tulsidas C. Patel
*Assistant Examiner*—Vlaimir Imas
(74) *Attorney, Agent, or Firm*—Bacon & Thomas

(57) ABSTRACT

An electric plug having a pull ring for pulling by hand to disconnect the electric plug from the electric socket is disclosed. The pull ring has a C-shaped shank, two necks respectively extended from the two distal ends of the C-shaped shank and respectively coupled to a respective through hole at the housing of the electric plug, and two end stops of diameter greater than each through hole at the housing respectively formed integral with the necks opposing the C-shaped shank and respectively stopped inside the housing to prevent disconnection of the pull ring from the housing as the user pulls the pull ring to remove the electric plug from the electric socket.

3 Claims, 6 Drawing Sheets

ELECTRIC PLUG

BACKGROUND OF THE INVENTION

1. Field of the Invention

The present invention relates to electric plugs and more particularly, to an electric plug having a pull ring.

2. Description of the Related Art

FIGS. 5 and 6 show a conventional flat type electric plug 70. For easy removal of the electric plug 70 from the electric socket, a pull ring 72 is pivotally coupled to the housing 71 of the electric plug 70. According to this design, the pull ring 72 is an arched wire rod having two hooked ends respectively hooked in the housing 71. If the pulling force surpasses the binding force between the pull ring 72 and the housing 71 when the user pulls the pull ring 72, the pull ring 72 will be deformed and disconnected from the housing 71. Because this flat type electric plug 70 has a thin thickness, it is difficult to pull the electric plug 70 from the electric socket after disconnection of the pull ring 72 from the housing 71.

SUMMARY OF THE INVENTION

The present invention has been accomplished under the circumstances in view. It is the main object of the present invention to provide an electric plug with a pull ring, which prevents disconnection of the pull ring from the housing of the electric plug when the user pulls the pull ring to disconnect the electric plug from the electric socket.

To achieve this object of the present invention, the electric plug comprises a housing having an inside chamber and two through holes in communication with the inside chamber at two opposite lateral sides, at least two conductive members disposed inside the housing, an electric wire inserted into the housing and electrically connected to the conductive members, and a pull ring pivotally coupled to the housing. The pull ring comprises substantially a C-shaped shank and two coupling portions respectively extended from two distal ends of the C-shaped shank and respectively coupled to the through holes of the housing. Further, the pull ring comprises two end stops respectively formed integral with the coupling portions and respectively stopped inside the housing to prevent disconnection of the pull ring from the housing as the user pulls the pull ring to remove the electric plug from the electric socket. The end stops each have a diameter greater than the through holes of the housing.

DETAILED DESCRIPTION OF THE INVENTION

Figure 1:
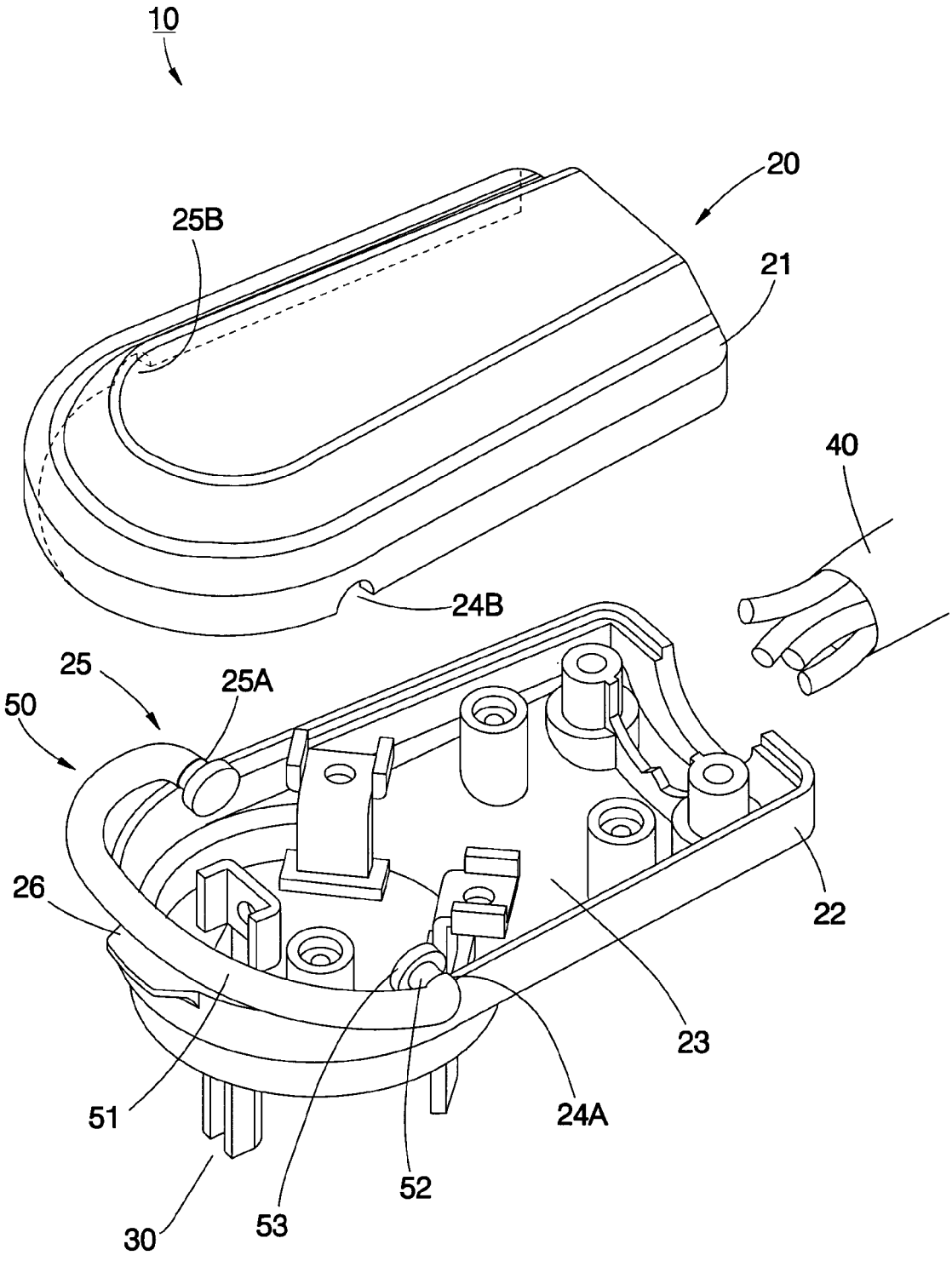
FIG. 1 is an exploded view of an electric plug according to a first preferred embodiment of the present invention.
Figure 2:
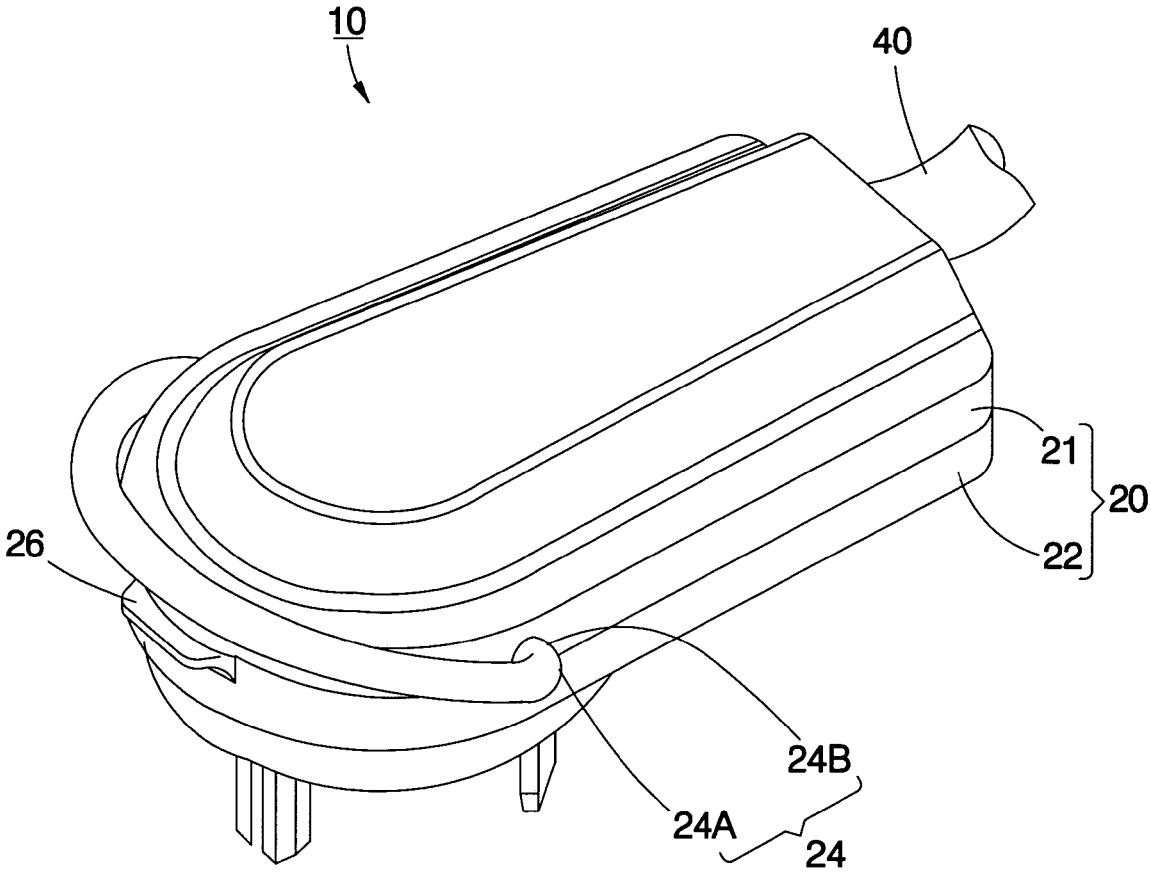
FIG. 2 is a perspective assembly view of the electric plug according to the first preferred embodiment of the present invention.

Referring to FIGS. 1 and 2, an electric plug 10 in accordance with the first preferred embodiment of the present invention is shown comprised of a housing 20, three conductive members 30, an electric wire 40, and a pull ring 50.

The housing 20 is comprised of two symmetrical half shells, namely, the upper half shell 21 and the bottom half shell 22, defining an inside chamber 23. The two symmetrical half shells 21 and 22 each have two notches 24A, 24B, 25A and 25B formed in the peripheral edge at two opposite lateral sides. When the two symmetrical half shells 21 and 22 are fastened together, the notches 24A, 24B, 25A and 25B form two through holes 24 and 25 in communication with the inside chamber 23 at two opposite lateral sides. The conductive members 30 are metal members respectively perpendicularly fastened to the bottom half shell 22. The electric wire 40 is inserted through one end of the housing 20 into the inside of the inside chamber 23, having the inside conductors thereof respectively connected to the conductive members 30.

The main features of the present invention are outlined hereinafter with reference to FIGS. 1 and 2 again. The housing 20 comprises a front protruding portion 26 extending from the peripheral wall between the two through holes 24, 25. The pull ring 50 can be a metal wire rod or elastic plastic rod member, having a C-shaped shank 51, two expanded end stops 53, and two coupling portions, for example, necks 52 connected between the expanded end stops 53 and the two distal ends of the C-shaped shank 51. The expanded end strops 53 have a diameter greater than the through holes 24, 25. The C-shaped shank 51 has a diameter greater than the through holes 24, 25. The necks 52 have a diameter smaller than the through holes 24, 25. During assembly process of the electric plug, the pull ring 50 is attached to the bottom half shell 22 to have the necks 52 respectively rested in the notches 24A, 25A, and then the upper half shell 21 is fastened to the bottom half shell 22 to have the notches 24B, 25B in match with the notches 24A, 25A respectively. When assembled, the pull ring 50 is pivoted to the housing 20, and the two expanded end stops 53 are respectively stopped inside the housing 20, preventing disconnection of the pull ring 50 from the housing 20. When the pull ring 50 is not in use, it is rested on the front protruding portion 26, i.e., the front protruding portion 26 prohibits the pull ring 50 from moving toward the conductive members 30.

As indicated above, the structure of the electric plug is simple. It is also easy to assemble the parts of the electric plug. When assembled, pulling the pull ring with force does not cause disconnection of the pull ring from the housing.

Figure 3:
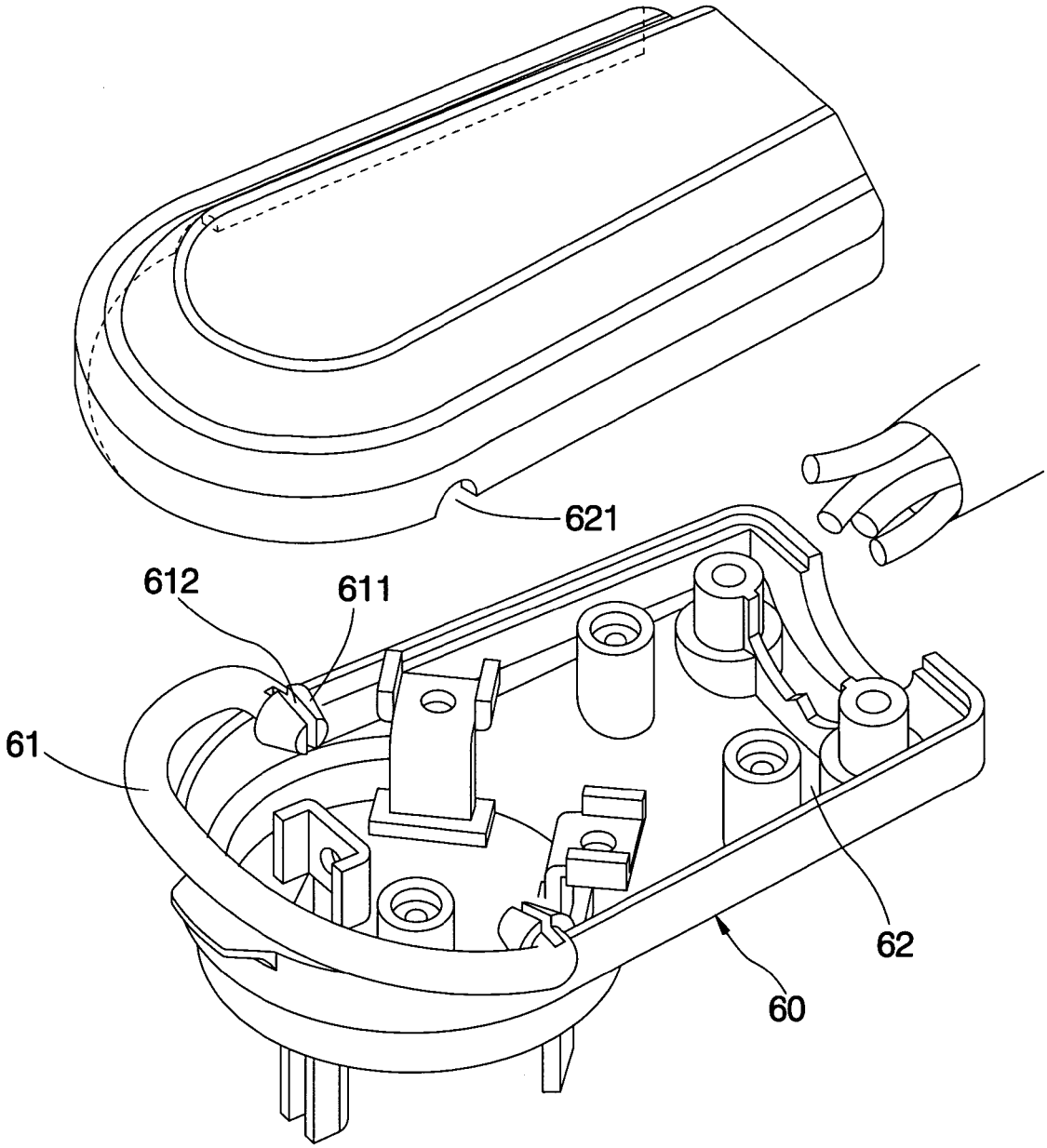
FIG. 3 is an exploded view of an electric plug according to a second preferred embodiment of the present invention.
Figure 4:
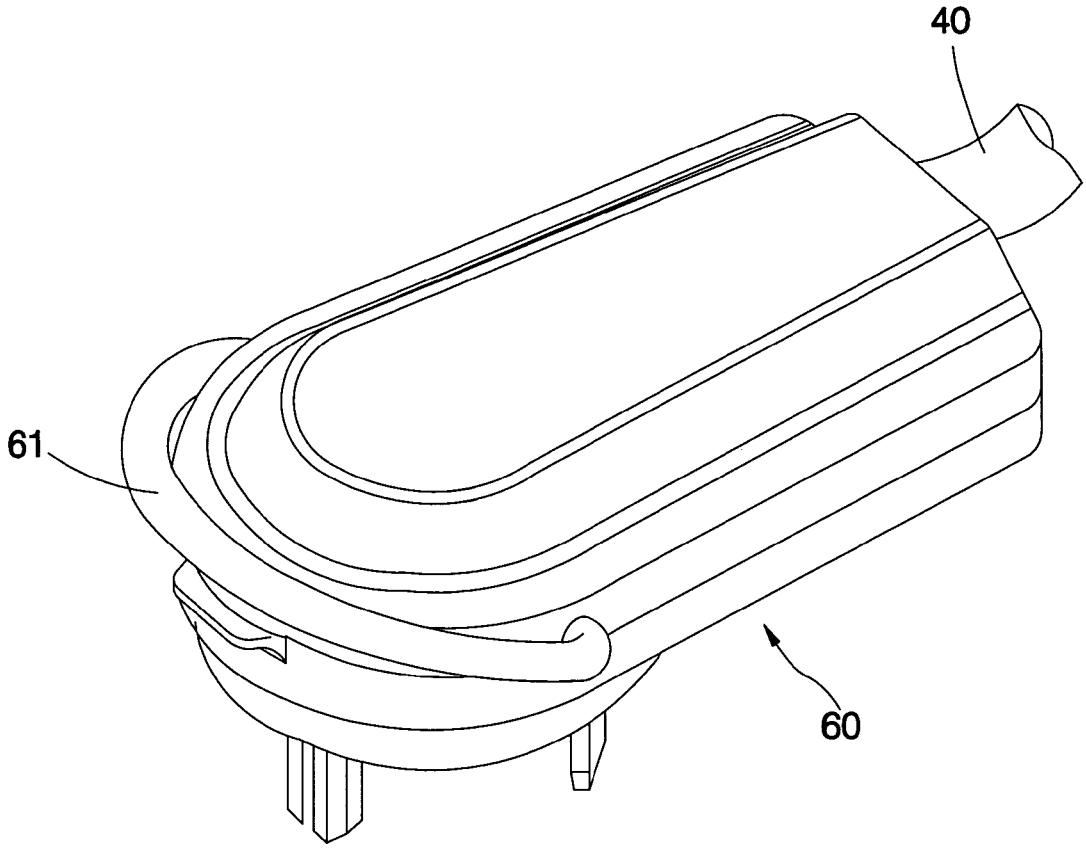
FIG. 4 is a perspective assembly view of the electric plug according to the second preferred embodiment of the present invention.
Figure 5:
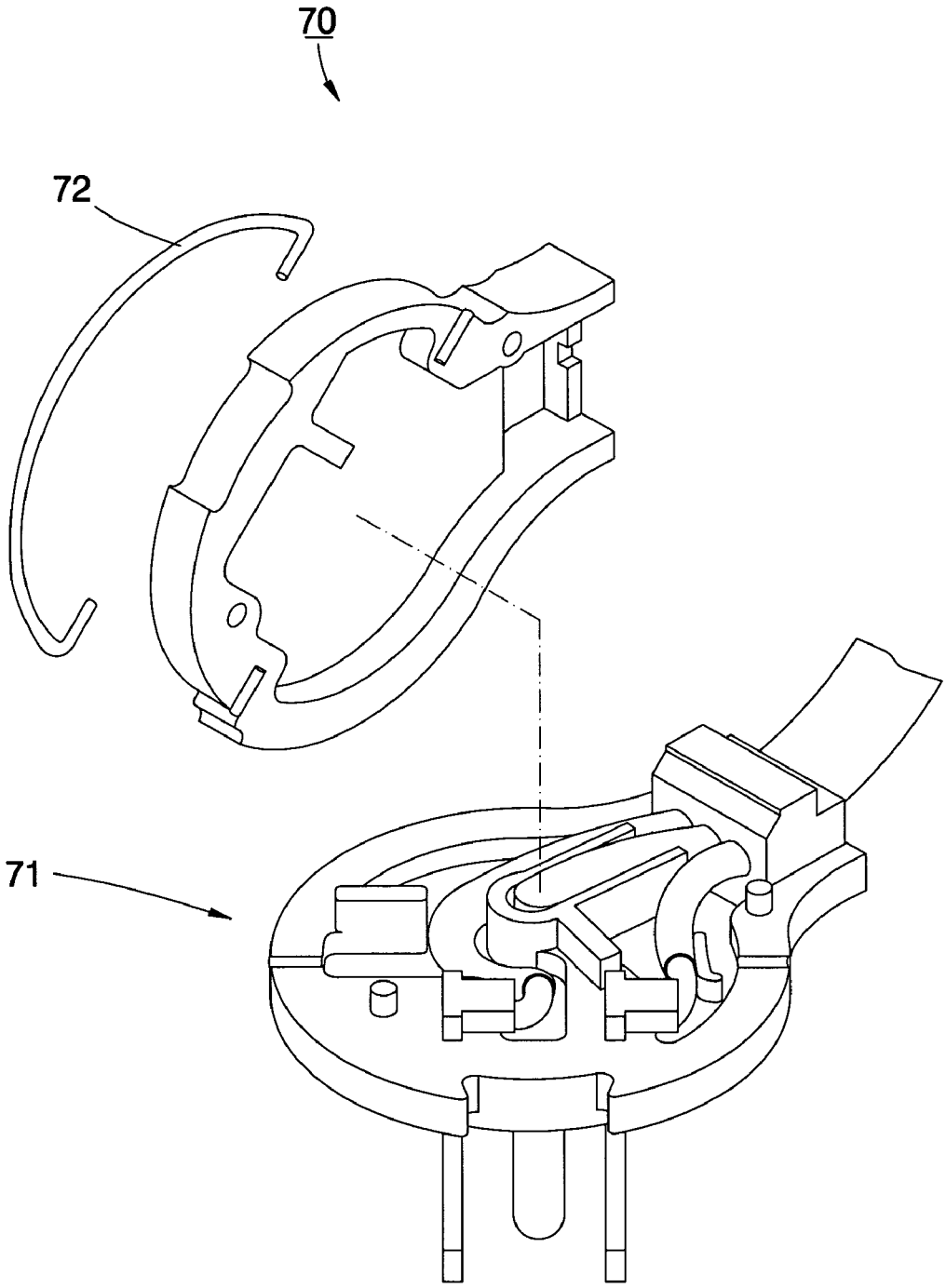
FIG. 5 PRIOR ART
FIG. 5 is an exploded view of a conventional flat type electric plug.
Figure 6:
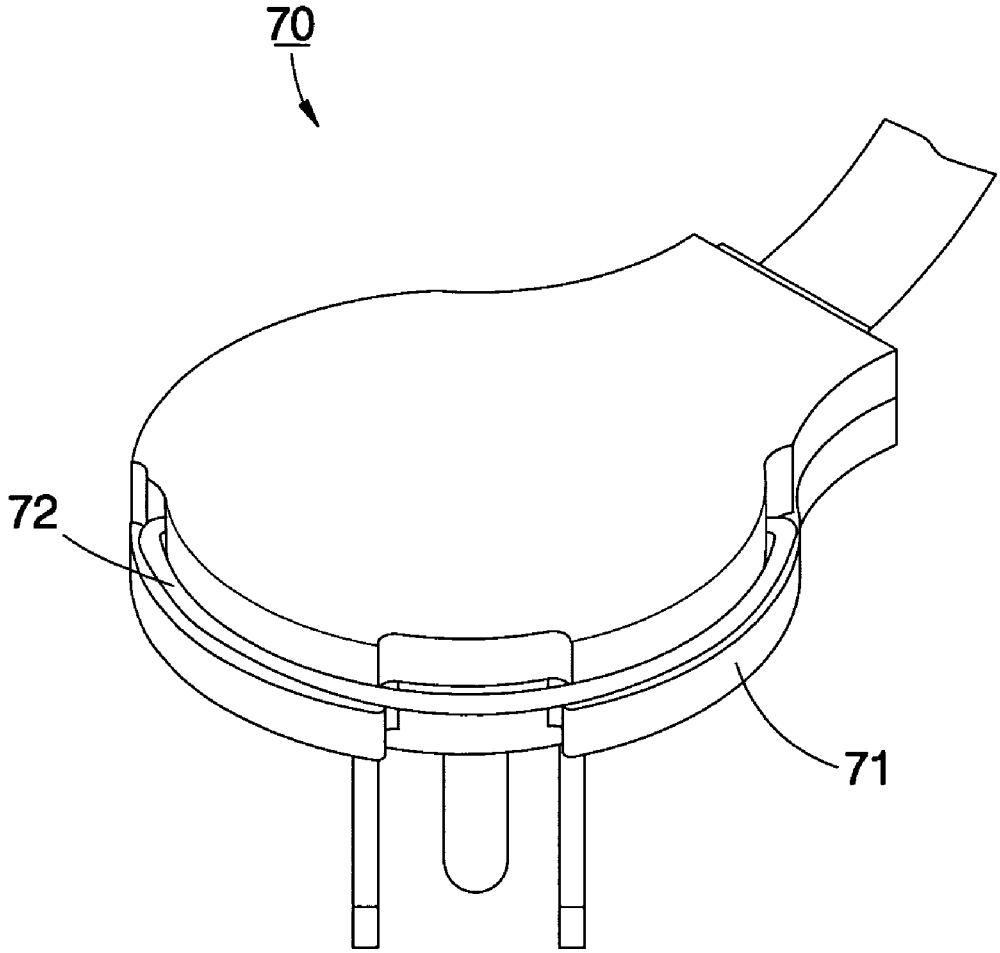
FIG. 6 PRIOR ART
FIG. 6 is a perspective assembly view of the conventional flat type electric plug shown in FIG. 5.

FIGS. 3 and 4 show an electric plug 60 according to the second preferred embodiment of the present invention. According to this embodiment, the pull ring 61 has two tapered end stops 611 and two crevices 612 respectively cut through the length of the tapered end stops 611. The tapered end stops 611 have a diameter made gradually reducing toward the distal end. The smallest diameter portion of the tapered end stops 611 is smaller than the through holes 621 of the housing 62. However, the greatest diameter portion of the tapered end strops 611 is greater than the through holes 621 of the housing 62. Therefore, the tapered end stops 611 can be radially inwardly compressed and then respectively inserted through the through holes 621 into the inside of the housing 62. After insertion of the tapered end stops 611 through the through holes 621 into the inside of the housing 62, the tapered end stops 611 immediately return to their former shape and stopped at the inside wall of the housing 62 around the through holes 621.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electric plug comprising:

a housing having an inside chamber and two through holes in communication with said inside chamber at two opposite lateral sides;

at least two conductive members respectively disposed in said inside chamber of said housing;

an electric wire inserted into said housing and electrically connected to said conductive members; and a pull ring having substantially a C-shaped shank and two coupling portions respectively extended from two distal ends of said C-shaped shank and respectively coupled to the through holes of said housing; and wherein said pull ring further comprises two end stops respectively formed integral with said coupling portions and respectively stopped inside said housing, said end stops are tapered stop members, each having a relatively smaller outer end, a relatively greater inner end, and a crevice extending from said relatively smaller outer end toward said relatively greater inner end, said relatively smaller outer end having a diameter smaller than said through holes of said housing, and said relatively greater inner end having a diameter greater than said through holes.

2. The electric plug as claimed in claim 1, wherein said housing comprises an upper half shell and a bottom half shell; said upper half shell having two notches and said bottom half shall having two notches corresponding respectively to the two notches of said upper half shall and defining respectively with the two notches of said upper half shell said two through holes.

3. The electric plug as claimed in claim 1, wherein said housing comprises a protruding portion extending from one end thereof for holding said pull ring.

* * * * *